US005403982A

United States Patent [19]

Nolte et al.

[11] Patent Number: 5,403,982

[45] Date of Patent: * Apr. 4, 1995

[54] ENCLOSED ELECTRICAL CONTACT ASSEMBLY FOR DYNAMOELECTRIC MACHINES

[75] Inventors: Duane R. Nolte; Gary L. Shurter, both of Wausau, Wis.

[73] Assignee: Marathon Electric Mfg. Corp., Wausau, Wis.

[ * ] Notice: The portion of the term of this patent subsequent to Feb. 1, 2011 has been disclaimed.

[21] Appl. No.: 136,306

[22] Filed: Oct. 13, 1993

Related U.S. Application Data

[62] Division of Ser. No. 885,126, May 18, 1992, Pat. No. 5,283,405.

[51] Int. Cl.[6] ..... H01H 35/10

[52] U.S. Cl. ..... 200/80 R; 73/535; 200/302.1; 310/68 E

[58] Field of Search ..... 310/68 E; 200/80 R, 200/302.1, 239, 246, 283, 306, 83 C, 83 Z; 318/462, 793; 307/120; 277/212 FB; 73/535, 538, 546, 550

[56] References Cited

U.S. PATENT DOCUMENTS

| | | | |
|---|---|---|---|
| 2,662,143 | 12/1953 | Eckles | 280/163 |
| 2,813,180 | 11/1957 | Hantack | 200/166 |
| 2,816,199 | 12/1957 | Staak et al. | 200/168 |
| 3,015,011 | 12/1961 | Seagreaves | 200/168 |
| 3,684,819 | 8/1972 | Wilson | 174/53 |
| 3,694,595 | 9/1972 | Horecky | 200/61.76 |
| 4,296,287 | 10/1981 | Boulanger et al. | 200/83 |
| 4,401,896 | 8/1983 | Fowler et al. | 307/118 |
| 4,414,443 | 11/1983 | Gehrt | 200/80 |
| 4,894,495 | 1/1990 | Toda | 200/51.12 |
| 4,922,066 | 5/1990 | Crow et al. | 200/80 |
| 4,927,988 | 5/1990 | Nolte | 200/80 |
| 5,283,405 | 2/1994 | Nolte | 200/80 R |
| 5,285,035 | 2/1994 | Williams | 200/80 R |

FOREIGN PATENT DOCUMENTS

| | | | |
|---|---|---|---|
| 762636 | 11/1956 | United Kingdom | 200/302.1 |

*Primary Examiner*—Gerald P. Tolin

*Attorney, Agent, or Firm*—Andrus, Sceales, Starke & Sawall

[57] ABSTRACT

A centrifugal switch assembly for a single phase induction motor connecting a start winding and/or start capacitors in circuit. A centrifugal actuator positions a contact unit on a cantilevered spring arm relative to an aligned fixed contact unit. Each contact unit is identically constructed with a cylindrical steel base and an outer contact button which defines a radial lip. A silicone rubber boot in the form of a tubular member having similar thick end hubs connected by a thin-wall convolution between the hubs to establish a flexible enclosure. The hubs are telescoped respectively over the contact bases with the same interference fit to totally enclose the contact units. The lips of the contact buttons lock the boot to the contact units. The boot length is greater than the spacing of the open contact units and the convolution is continuously deflected to create a closing force. A pressure relief pin hole is formed in a crease at the connection of the convolution and the hub secured to the final contact unit to allow air flow from the enclosed contacts and uninterrupted closure of the switch assembly.

5 Claims, 2 Drawing Sheets

FIG. 1
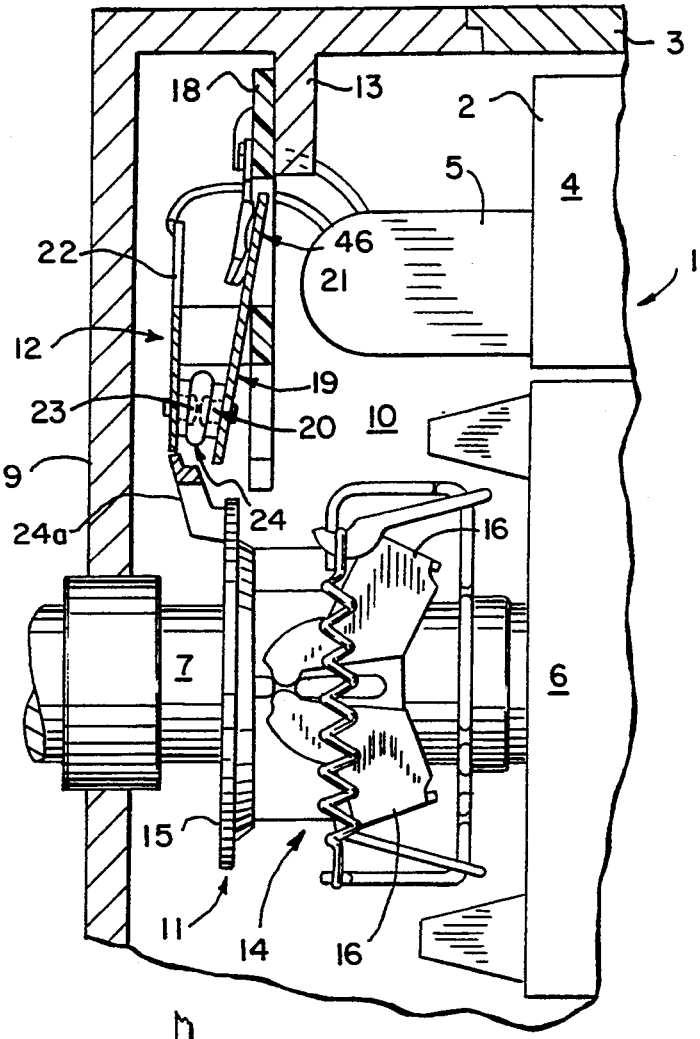
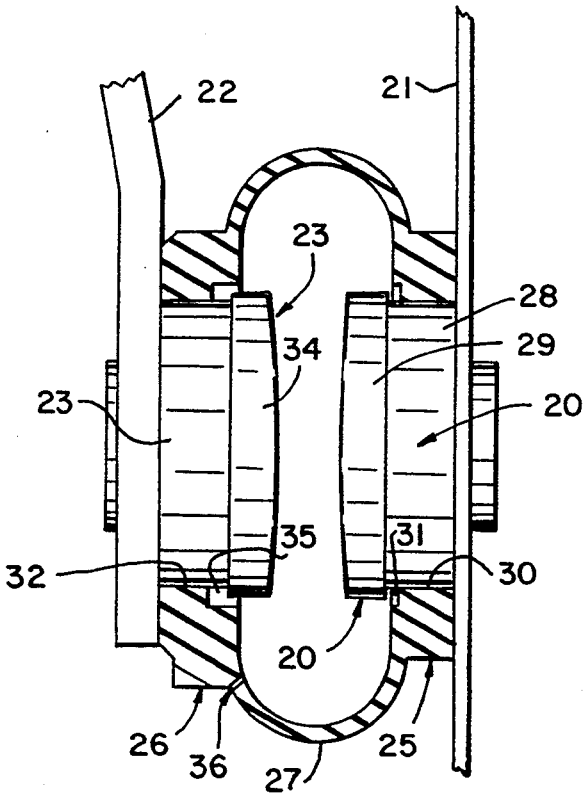
FIG. 2

ENCLOSED ELECTRICAL CONTACT ASSEMBLY FOR DYNAMOELECTRIC MACHINES

This is a division of application Ser. No. 07/885,126, filed May 18, 1992, now U.S. Pat. No. 5,283,405, issued Feb. 1, 1994.

BACKGROUND OF THE INVENTION

This invention relates to an enclosed electrical contact assembly and particularly to a contact assembly adapted for operation in environments including airborne particles.

U.S. Pat. No. 4,927,988 was issued May 22, 1990 to the present inventor and discloses a centrifugal switch assembly for controlling of electric motors in which the contact assembly is enclosed to prevent adverse affects from airborne contaminants including chemical substances, foreign particles and the like. As more fully disclosed in such patent as well as the prior art cited during the prosecution thereof, various systems have been provided for enclosing of the contact gap between contacts in various switch units. In particular, a flexible boot unit is often connected to the respective mounting elements for the contacts to shield the enclosed gap between the contacts and the contact surfaces from environmentally airborne foreign substances.

As most fully disclosed in the '988 patent, the opposed contacts include a first contact mounted essentially as a fixed contact and the opposing contact mounted on leaf spring support for movement into and from engagement with the fixed contact. A centrifugal actuator is selectively coupled to the movable contact leaf spring support for opening and closing of the contacts and, in particular, to provide a forced closing and a snap action release as a result of the mounting of the movable contact. The enclosure included a convoluted boot member having a first tubular portion secured to the movable contact by an interference fit and a second tubular mount portion encircling the fixed contact and spaced therefrom, with a pressurized engagement between the tubular portion and the fixed support structure. Thus, the mounting and actuation of the movable member maintained firm interengagement of the second tubular portion with the fixed support structure.

The inventor's laboratory testing has found a significant improvement in performance and expected life with the subject switch design compared to the prior art switch enclosures. The improvements focused on eliminating the entry of foreign debris into the protective enclosure either during the assembly process or during the application of the product. The improvements included: an improved seal of the boot structure to the contacts, a structure which allows release of internal pneumatic conditions resulting from the more effective seal of the enclosure about the contacts, and improved assembly and storage procedures to maintain clean components.

The prior art as cited in the Nolte patent discloses other systems wherein an enclosure is otherwise formed with various interconnections between the enclosure and the opposing contacts. For example, Seagraves U.S. Pat. No. 3,015,011 discloses a boot structure with offset tubular portions, one of which telescopes over one contact and is secured thereto by an interference fit, with the opposite enclosure end projecting into a separate cup-shaped member overlying the opposite contact. A similar total enclosure is shown in U.S. Pat. No. 4,922,066 which issued May 1, 1990. Other dust proof switches are shown in the other references cited in the several patents discussed.

The prior art is not considered to disclose either the problems found by Applicant or a structure which will eliminate such problems.

SUMMARY OF THE INVENTION

The present invention is particularly directed to an improvement in the enclosed switch assembly including an convoluted or bellows enclosure, hereinafter referred to as a boot, with the opposite ends, in accordance with the present invention, securely interconnected to the periphery of both contacts through firm interference fits and with special construction to minimize interference with the contact movement while essentially tightly sealing the environment surrounding the contact units within the boot from environmental borne material. To avoid any temporary delay in the action of the contact units in the switch assembly, a small opening or hole is introduced into the enclosure or boot, which hole is small enough to prevent entry of environmentally borne particles while allowing the escape of trapped environment fluid without affecting any noticeable delay in the action of the enclosed switch assembly.

More particularly in accordance with the present invention, each of the contact units is formed with a circular periphery. The boot design is formed with heavy tubular ends or hubs adapted to telescope over the respective opposed contacts. Each tubular hub, however, is specially formed with an unstressed, internal diameter significantly less than the outer diameter of the contact unit such that the boot is secured to the respective contacts with a firm interference fit. With respect to a particularly satisfactory and preferred structure, applicant doubled the interference fit on the movable contact unit from the switch assembly shown in the '988 patent and provided a similar interference fit with respect to the fixed contact unit. Further, to improve the system operation, the contact units were formed with a backing or base of steel or other suitable conductive metal or the like and which is fixed to the respective contact support member. An enlarged outer button contact is firmly secured to the steel base. Each enclosure end is formed with an interference fit with the backing or base such that button contact positively prevents possible movement of the hubs from the respective contact unit.

The tubular end hubs are recessed on the inner ends to fit over the enlarged button contact during the movement of the switch assembly to the closed position.

In addition, in a preferred construction, the boot structure includes an annular convolution or bellows interconnected between the two tubular mounting ends or hubs. A small air release hole is introduced into the enclosure and in particular the convoluted portion preferably immediately at the junction between the convolution and the heavy tubular hub secured to the fixed contact unit. The release hole is readily formed by using a sharp pick-like element which is forced inwardly at the function of the convolution and the tubular end member.

In addition, in fabricating of the enclosed switch assembly, the parts are not only thoroughly cleaned but are separately stored in sealed packages until used in assembly and the final assemblies are similarly stored.

The improvements in structure, as well as care taken in the cleaning of the switch components and assembly to minimize the probability of entrance of foreign matter into the enclosure of the switch assembly during the construction and fabrication of the switch assembly and mounting within the motor, have been found to significantly increase the life of the switch assembly when operating in an environment which carries a high percentage of airborne dust and the like.

In summary, the present invention by the rather simple structural modification provided in the switch assembly, particularly with care in assembly thereof, has been found to produce a significant improvement in the operational characteristics of the switch assembly and a highly significant improvement in the reliability and life of the switch assembly.

BRIEF DESCRIPTION OF THE DRAWINGS

The drawings illustrate the best mode presently contemplated of carrying out the invention.

In the drawings:

FIG. 1 is a partial view of a single phase motor with a centrifugally actuated starting switch assembly incorporating a flexible contact enclosure illustrating embodiment of the present invention;

FIG. 2 is an enlarged view of the switch assembly and support with the contacts open and with the flexible contact enclosure in section;

DESCRIPTION OF THE ILLUSTRATED EMBODIMENT

Figure 3:
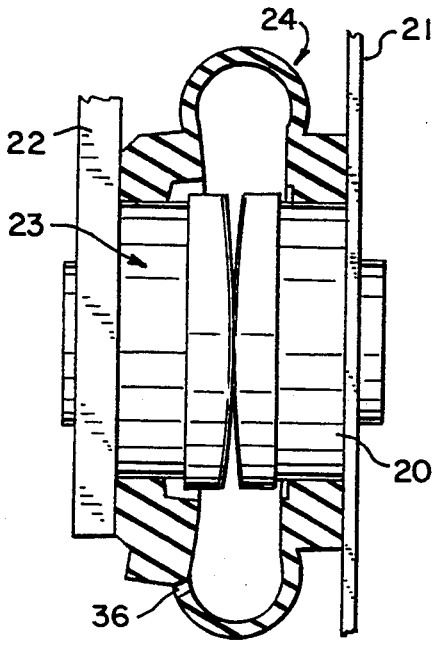
FIG. 3 is a view similar to FIG. 2 illustrating the movement of the contacts to the closed position.

A fragmentary portion of an induction motor as illustrated in the Nolte '988 patent is shown in the drawings. The motor 1 includes an annular stator 2 mounted within an outer tubular frame 3. The stator 2 includes a magnetic stator core 4 secured to the frame 3. A field winding 5 is wound in the stator core 4. The field winding 5 generally includes a run winding and an offset separate start winding which are interconnected to each other and to power supply in accordance with well known constructions and is not specifically and separately shown herein. In accordance with conventional practice, a rotor 6 having a motor shaft 7 is rotatably mounted within the stator 2. The motor shaft 7 is supported within a cup-shaped end closure bell 9 secured in abutting relation to the outer end of the tubular motor frame 3. The end bell 9 defines an end chamber 10 within which a centrifugally actuated start switch assembly 11 is located. The switch assembly 11 is electrically connected into circuit with the start winding of winding 5 and/or start capacitors for selected connection of the start winding and/or capacitors into the circuit only during the starting of the motor and until such time as the rotor reaches a predetermined speed prior to normal operating speed. The assembly 11 includes a start switch unit or apparatus 12 which is mounted on a suitable bracket 13 within the end chamber 10 immediately adjacent to the axial end of field winding 5. A centrifugal actuator 14 is located on the motor shaft 7 and in particular includes a hub 15 which is slidably mounted on the shaft 7 and coupled to centrifugal weights 16. The actuator 14 is coupled to switch unit 12 at rest (FIG. 1) and serves to hold the switch unit closed to connect the start winding and/or start capacitors into circuit during the initial starting period. At a desired or switching speed, the centrifugal weights 16 move outwardly, as shown in phantom, with a snap action under the force of the rotational centrifugal forces, and provide a correspondingly retracting movement of the hub 15 which snaps outwardly from the switch unit 12 and opens the circuit of the start winding and/or start capactors. The switch assembly other than for the enclosed contact unit is also disclosed in U.S. Pat. No. 4,419,550 which issued Dec. 6, 1983. The details of the centrifugal actuator 14 and switch unit 12 may also be of any other known or other desired construction and no further description of the detail of such components is therefore given herein other than as necessary to a full description and understanding of this invention.

Figure 4:
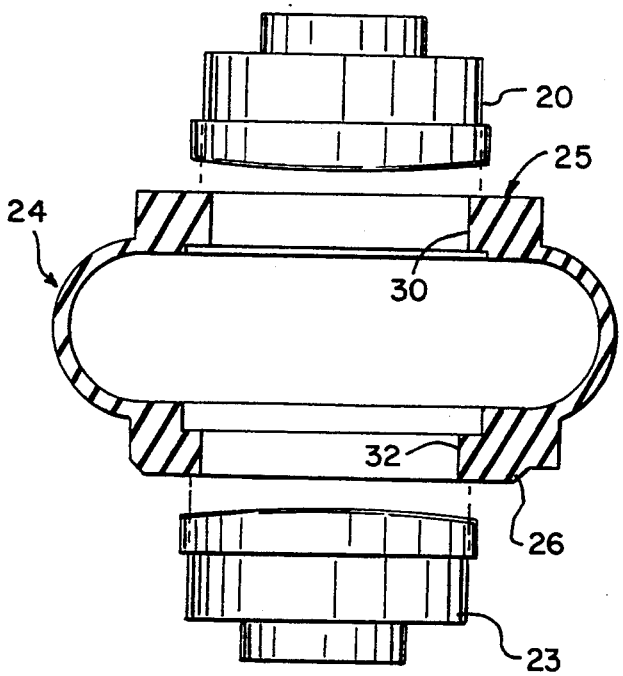
FIG. 4 is an exploded view, with parts broken away and sectioned, to more clearly illustrating the relative construction of the contacts and the contact enclosure in accordance with the illustrated embodiment of the present invention.
Figure 5:
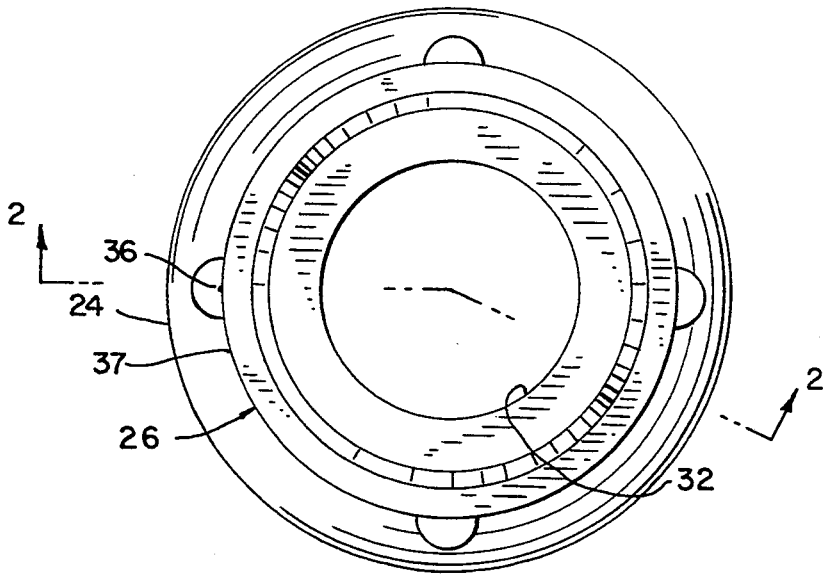
FIG. 5 is an end view of the enclosure illustrated in FIGS. 1–4.

The illustrated switch unit 12 generally includes an insulating flat base plate 18 secured to the bracket 13. A spring unit 19 is secured to the base plate and carries a movable contact unit 20 on the end of cantilevered leaf spring arm 21. A fixed contact mounting support or cover 22 is secured to the insulating plate and supports a fixed contact unit 23. The fixed contact unit 23 is located in substantially aligned and opposed relation to the movable contact unit 20, and is selectively engaged by the contact unit 20 by deflecting of the spring arm 21. A dust proof enclosure or boot 24 is coupled to the contact units 20 and 23 to enclose and protect the contacts from contaminants in the motor environment, and particularly forms an embodiment of the present invention, as more clearly shown in FIGS. 2–5 inclusive.

The spring unit 19 includes a coupling pad **24*a* located in the path of the actuator hub 15 for selective axial positioning of the spring arm 21 and the interconnected contact unit 20 with respect to the fixed contact unit 23** between an engaging closed switch position and a spaced released open switch position.

More particularly and as more clearly shown in FIGS. 2 through 5, the enclosure or boot 24 is an integral tubular member having tubular mounting and circular end hubs 25 and 26 joined by a convoluted or bellows portion 27, shown as single convolution with a C-shaped cross section and deflection portion. The circular ends or hubs 25 and 26 are similarly coupled to the movable contact unit 20 and to the fixed contact unit 23 respectively, and define a complete dust and environment proof enclosure, as presently developed hereinafter.

The circular hub 25 is coupled to the movable contact unit 20.

In the illustrated embodiment, the contact unit 20 is a button-type contact having a solid backing or base 28 of a suitable conductive metal such as steel. An outer contact button 29 is secured or integrally formed with outer end of the base 27 and is formed of an appropriate, highly conductive material such as silver alloy. The contact button 29 has an outer semispherical surface to produce optimum contact with the opposed contact unit 23 in accordance with conventional practice. The diameter of the button 29 is slightly larger than the diameter of the backing or base 28 and forms a radial protrusion and lip on the end of the base.

The circular tubular hub 25 of the boot 24 is a relatively thick, self-supporting and stable end portion. The boot hub 25 has a circular opening 30, which in the unstressed state of the hub, has a diameter less than the diameter of the base 28. The elasticity of the boot is such that the hub 25 is readily placed over the contact button 29 into a firm interference fit with base 28 open. The difference in the diameter is more clearly shown in FIG. 4.

In a commercial construction, the boot hub adjacent the fixed contact unit had an internal diameter of approximately 0.240 inches. The diameter of the contact, in contrast, was constant at about 0.252 inches throughout the depth of the contact. In the new design, the nominal diameter of the silver alloy disk forming the contact button 29 remains that same diameter while the steel base has a reduced diameter of approximately 0.231 inches. Thus, the diameter of the backing member or base has been reduced by approximately 0.020 inches.

The diameter of the boot opening 30 in hub 25 has been more significantly reduced from 0.240 inches to approximately 0.210 inches, thereby significantly increasing the interference fit between the boot hub 25 and the contact base 28. The radial extension or lip of the contact button 29 beyond the periphery of the backing base establishes an interlock which positively presents the boot hub 25 from slipping from the contact over the life of the switch assembly.

To maintain a small compact assembly, the boot 24 is specially constructed with a small circular recess 31 on the inner face of the coupling hub 24 to accommodate the flexing movement of the boot with respect to the contact structure. The recess 31 in hub 25 for the above reference construction had a depth of about 0.006 inches.

The opposite boot end or hub 26 of boot 24 is a similar relatively heavy and thick end member of a slightly greater depth than the hub 25 and having a circular inner opening 32. The outer surface of hub 26 is a planar face and is adapted to abut the mounting bracket 22 for the fixed contact unit 23. The contact unit 23 is similar in structure and size to unit 20 and includes a base 23 and a contact button 34. In the present invention, the second boot hub 26 is constructed similar to that of the first described boot end 25 and includes the circular inner opening 32 of a diameter less than the diameter of the contact base 33 for the fixed contact unit 23. Hub 26 has a slightly greater axial length than hub 25 and for the above referenced commercial structure had a length of about 0.059 inches versus 0.039 inches for hub 25. The hub 26 has the central opening 32 of essentially the same diameter as that of the boot hub 25, and provides a similar interference fit over the backing base 33 of the fixed contact unit 23. In particular, the contact base has a diameter of about 0.231 inches, while the diameter of the hub is 0.210 inches to produce a firm interference fit. In contrast, the prior Nolte U.S. Pat. No. 4,927,988, the hub opening diameter was about 0.265 and the contact diameter was a constant at 0.252, leaving a radial gap. The seal was made solely by pressure engagement between the hub and support.

The inner edge of the boot end 26 is also recessed as at 35 to accommodate the extended contact button 34 of the fixed contact unit 23 which insures a positive interconnection of the boot to the contact over the life of the switch assembly. The recess 35 in the hub 26 is somewhat deeper than that in the recess of the hub 25. In the previously identified structure, recess 35 had a depth of about 0.026 inches and the recess 31 about 0.006 inches. This difference assures the appropriate flexing of the boot 24 with the movement of the movable contact unit 20.

The integral convolution 27, as in inventor's previous patent, is a relatively thin wall member and has an appropriate thickness and elasticity to permit a high degree of flexibility of the wall structure for the same reason as in the prior structure. The depth of the boot structure may be maintained as in the previous design and, thus, provide a slightly greater gap between the contact buttons in the switch open position. The leaf spring 21 will maintain a resilient force on the boot, collapsing the convolution 27 slightly to further assist in the maintaining of the boot in the original engagement with the backing or support arms of the contacts. However, with the interference fit to both of the contacts, the resilient force of the leaf spring is not relied on to establish the seal of the contact enclosure.

Further in accordance with the present invention, a small opening or hole 36 is introduced into the boot structure providing restricted communication between the exterior of the boot and contact assembly and the interior defined by the boot and contacts. In the illustrated embodiment of the invention, the hole 36 is provided immediately adjacent the outer boot hub 26 and particularly in the crease 37 between the hub 26 and the convolution 27. The hole 36 is shown substantially enlarged in the drawing for purposes of illustration. The elasticity of the boot 24 is such that hole 36 is operatively closed in the final switch assembly but allows entrapped air or the gaseous fluid to escape with the closing movement of the movable contact unit 20. The hole 36 will also permit entrance of air to prevent creation of a vacuum condition in the enclosure which might interfere with the desired opening of the contacts. The hole is preferably formed through the simple procedure of forcing a sharp pick-like member into the crease 37 and through the boot 24 to produce the small restricted hole 36. The hole 36 is thus readily formed using a simple mechanical tool generally similar to an ice pick having a very thin tapered outer end formed of a suitable metal. For example, in a commercial construction employing a boot having a diameter on the order of ½ inch and with the boot having an outer thickness of approximately 4/10ths of an inch, a sharp dental pick formed the hole. The pick had a diameter of approximately 0.03 inches at the point of maximum insertion.

In forming and fabricating of the switch assembly, the boot as formed, and prior to assembly, should be thoroughly cleaned to remove possible contaminant and then stored in a sealed condition such as in a sealed plastic bag. The other switch part should also be thoroughly cleaned and retained in suitable storage such as sealed plastic bags both prior to assembly and during assembly. The equipment in the assembly area should also be specially treated to establish a clean environment.

In the assembly of the start switch apparatus 12, the preferred procedure for producing an environmentally clean assembly is as follows. The contact units 20 and 23 are first assembled to the spring unit 19 and to the cover 22, with the wear pad **24*a*** secured to the leaf spring. The spring/cover/contact unit subassembly is thoroughly cleaned with pressurized filtered air, and the boot is then secured to the contact units and the subassembly mounted to the support board. The appropriate board connectors can then be provided. Only then is the pneumatic relief hole introduced into the boot as previously described to complete the switch assembly. The total switch assembly is then "gaged" with suitable instrumentation and the "gaged" switch assembly placed in an appropriately cleaned storage box.

Further, each combination of the switch supports, switch contacts, and boot assembly should be completed before moving onto another switch assembly.

Tests in connection with the switch assembly of this invention has shown a highly significant improvement in the operation of the switch assembly in a motor environment with significant small particles such as saw dust or like sized particles. Simulated testing of a switch and motor has been conducted in a vertical sawdust sift test. For example, comparative sawdust sift tests with on and off cycling of the motors in a clean environment were conducted and motors with a switch as disclosed herein had an extremely long life response and clearly established that such switch was superior to the prior art switches.

In summary, the enclosed switch assembly of the present invention essentially eliminates contamination as a mode of failure and, by following appropriate clean fabrication so as to eliminate contaminants created during the assembly process, will provide a long reliable operating centrifugally actuated switch with dust proof enclosure of the opposing contacts.

Various modes of carrying out the invention are contemplated as being within the scope of the following claims particularly pointing out and distinctly claiming the subject matter which is regarded as the invention.

I claim:

1. In a dynamoelectric machine having a circuit adapted to be selectively connected and disconnected in response to the rotational speed of the machine, a switch assembly comprising, a first mounting member, a first contact unit secured to said first mounting member and having an outer contact face, a second mounting member, a second contact unit secured to said second mounting member and having an outer contact face, said mounting members being located with said contact units in opposed aligned relationship to each other with said contact faces in opposed aligned relation to each other, at least one of said mounting members being movable to provide for placing said contact units in an open position with a gap therebetween and in a closed position with said contact units engaged, a single piece enclosure member having first and second end tubular hub portions and an intermediate closure portion, said first and second hub portions being secured in telescoped relation to said first and second contact units and establishing a continuous enclosure about said contact units within said enclosure member and thereby preventing entry of foreign matter into the gap between said contacts from the exterior of the enclosure member, and a normally closed pin hole formed in the enclosure member and establishing a limited and restricted fluid passageway between the exterior environment and said gap in response to pressure build up within the enclosure as a result of movement of the movable mounting member.

2. In the dynamoelectric machine of claim 1, wherein said closure portion includes at least one convolution, said normally closed pin hole being located in said convoluted portion.

3. In the dynamoelectric machine of claim 1, wherein said closure portion is a convoluted portion directly connected to said hub portions and has a relatively thin thickness relative to said end portions, said normally closed pin hole being located in said convoluted portion immediately adjacent one of said hubs.

4. In the dynamoelectric machine of claim 3, wherein said convoluted portion includes a single convolution having a substantially C-shaped cross section and integrally formed with said hub portions, the integral connection of said hub portions and said convoluted portions including a crease, said normally closed hole being located in said crease between said tubular hub portion and said convoluted portion.

5. In the dynamoelectric machine of claim 1, wherein said enclosure member is a single integral element formed of a silicon rubber and said closure portion is a relatively thin C-shaped convolution with the opposite ends of the convolution integrally formed with the hub portions, said hub portions having a radial thickness substantially greater than the thickness of said convoluted portion and providing a substantially firm and stable support for said convoluted portion and providing for deflection of the convoluted portion in response to relative movement of said contacts, said normally closed pin hole being located adjacent the exterior connection between the convoluted portion and one of said tubular hub portions.

* * * * *